US009122196B2

(12) United States Patent
Suzuki

(10) Patent No.: US 9,122,196 B2
(45) Date of Patent: Sep. 1, 2015

(54) IMAGE FORMING APPARATUS

(71) Applicant: CANON KABUSHIKI KAISHA, Tokyo (JP)

(72) Inventor: Hideaki Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/906,182

(22) Filed: May 30, 2013

(65) Prior Publication Data

US 2013/0322893 A1 Dec. 5, 2013

(30) Foreign Application Priority Data

Jun. 4, 2012 (JP) ..... 2012-127134

(51) Int. Cl.
*G03G 15/08* (2006.01)
*G03G 15/01* (2006.01)
*G03G 15/00* (2006.01)

(52) U.S. Cl.
CPC ..... *G03G 15/0822* (2013.01); *G03G 15/0189* (2013.01); *G03G 15/55* (2013.01); *G03G 2215/0129* (2013.01); *G03G 2215/0164* (2013.01); *G03G 2215/0888* (2013.01)

(58) Field of Classification Search
CPC ..... G03G 15/0822; G03G 15/0824; G03G 15/0825; G03G 15/0827; G03G 15/0829; G03G 15/0849–15/0855; G03G 2215/0164; G03G 2215/0888
USPC ..... 399/12, 27, 29, 30, 53, 58–62
See application file for complete search history.

(56) References Cited

U.S. PATENT DOCUMENTS

| | | | | |
|---|---|---|---|---|
| 7,269,364 | B2 * | 9/2007 | Tanaka et al. | 399/27 |
| 8,254,796 | B2 * | 8/2012 | Oyoshi | 399/29 |
| 2010/0316400 | A1 * | 12/2010 | Murasaki et al. | 399/49 |
| 2011/0013915 | A1 * | 1/2011 | Yamasaki et al. | 399/8 |

FOREIGN PATENT DOCUMENTS

| | | | |
|---|---|---|---|
| JP | 2000-56639 | A | 2/2000 |
| JP | 2002-365983 | A | 12/2002 |
| JP | 2010-91801 | A | 4/2010 |

* cited by examiner

*Primary Examiner* — David Gray
*Assistant Examiner* — Carla Therrien
(74) *Attorney, Agent, or Firm* — Canon USA Inc. IP Division

(57) ABSTRACT

An image forming apparatus is characterized by including a first developing device configured to develop an electrostatic latent image using a developer, a second developing device configured to develop an electrostatic latent image using a developer, a common driving source unit configured to commonly drive the first developing device and the second developing device, and an execution unit configured, in a case where only the first developing device is a new developing device, to execute a predetermined initialization operation to drive the first developing device and a toner discharge operation to discharge toner from the second developing device during the initialization operation.

8 Claims, 12 Drawing Sheets

IMAGE FORMING APPARATUS

BACKGROUND OF THE INVENTION

1. Field of the Invention

The present disclosure relates to image forming apparatuses configured to form an image using an electrophotographic method. In particular, the present disclosure relates to image forming apparatuses such as copying machines, printers, facsimiles, or multifunction peripherals including these multiple functions.

2. Description of the Related Art

In general, a two-component developer containing toner particles and carrier particles as main components is widely used in a developing device included in an electrophotographic or electrostatic-recording image forming apparatus. Especially in electrophotographic image forming apparatuses configured to form full color images and multi-color images, many developing devices use a two-component developer from a viewpoint of image tints.

As well known, the toner density of a two-component developer, i.e., the ratio of the weight of toner particles to the total weight of carrier particles and the toner particles, is a significantly important factor for stabilization of image quality. Toner particles of a developer are consumed during the development to change the toner density. Thus, it is necessary to accurately detect the toner density of the developer at appropriate timings and execute toner replenishment in response to a change in the toner density by use of an automatic toner replenishment control device (ATR), so that the toner density is constantly controlled within an appropriate range to maintain image quality.

Various types of toner density detection units configured to detect the density of toner in a developing container have been available to correct a change in the toner density in the developing device that results from development, i.e., to control the amount of toner to be replenished to the developing device.

For example, there is an optical toner density detection unit configured to detect the toner density using the phenomenon that the reflectance at the time when light is applied to a developer conveyed onto a developer bearing member (hereinafter "developing sleeve") varies depending on the toner density. Further, a toner density detection unit of an inductance detection method is also used in which the density of toner in a developing device is detected based on a detection signal from an inductance head, which detects the apparent magnetic permeability due to the blend ratio of magnetic carrier to non-magnetic toner of the developer and converts the detected apparent magnetic permeability into an electric signal. Another method that is widely used is a method in which a reference toner image is developed on an image bearing member at a predetermined timing and the density of the reference toner image is detected by an optical density detection unit, which is arranged to face the image bearing member or an intermediate transfer member, to control the toner density of a developer in a developing unit based on the detection result.

When the foregoing toner density detection unit or image density detection unit is used to control the toner density, an initialization operation needs to be executed immediately after a new developing device is installed into a main body of an image forming apparatus. The initialization operation is an operation to determine an output voltage for use as a control target by storing an output of the toner density detection unit or the image density detection unit in a state in which a developer is a new developing device and, thus, the toner density is known in advance. Thereafter, the amount of toner replenishment to the developing device is controlled to attain the target output voltage determined through the initialization operation (refer to, for example, Japanese Patent Application Laid-Open No. 2000-56639).

There are mainly two timings of execution of the initialization operation of a developing device, which are when the main body of the image forming apparatus is installed and when the developing device comes to the end of its endurance life to be exchanged for a new developing device. When the developing device comes to the end of its endurance life to be exchanged for a new developing device, only the developing device that comes to the end of its endurance life is exchanged in general. Thus, the initialization operation is executed only with respect to the exchanged developing device. During the initialization operation, an idle rotation operation needs to be executed to stabilize the height of the surface of the developer, or a development operation needs to be executed to determine the control target voltage for the toner density detection unit or the image density detection unit. Thus, a motor needs to drive the developing device during the initialization operation.

As to a developing device driving configuration, configuration in which a single common motor drives a plurality of developing devices have been suggested and implemented as well as a configuration in which a single motor drives a single developing device, i.e., developing devices of four colors are driven by respective four separate motors. In this case, for example, yellow, magenta, and cyan developing devices are driven by a single common motor, and a black developing device is driven by another motor. This configuration allows the number of motors to be decreased from four to two, so that the costs of the image forming apparatus can be reduced considerably. Furthermore, the space occupied by the motors can be decreased to reduce the size of the image forming apparatus.

However, problems arise when the initialization operation of a specific developing device among a plurality of developing devices driven by a single common motor is executed. The following describes the problems in a case in which, for example, only a yellow developing device among yellow, magenta, and cyan developing devices driven by a single common motor is exchanged and the initialization operation of the yellow developing device is executed.

When the initialization operation of the yellow developing device is executed, the developing device needs to be driven by the motor as described above. At this time, since the motor used to drive the yellow developing device is common to a motor that drives each of the magenta and cyan developing devices, the magenta and cyan developing devices are also driven at the same time although the initialization operation is not necessary for the magenta and cyan developing devices. Consequently, the magenta and cyan developing devices continue to be in an idle rotation state during the initialization operation of the yellow developing device. As a result, an external additive on a toner surface is embedded to cause deterioration, resulting in a significant decrease in developing performance and transfer property. In such a case, malfunctions such as decreased density and increased roughness of magenta and cyan images may suddenly arise after the initialization operation of the yellow developing device.

Further, a toner discharge control has been implemented to prevent problems in images arising from toner deterioration. In the toner discharge control, a predetermined amount of toner is discharged from a developing device during a non-image forming period and, at the same time, substantially the same amount of toner is replenished to replace the toner. In the conventional control method, the video count amount of printed images and the driving time of the developing device are respectively integrated, and whether the toner discharge control can be executed is determined based on the integrated values. Thus, when the driving time of each of the magenta and cyan developing devices, which are driven concurrently with the initialization operation of the yellow developing device, is integrated, the toner discharge control of the magenta and cyan developing devices may be executed immediately after the initialization operation of the yellow developing device is finished. In this case, a problem arises that downtime occurs immediately after the replacement of the developing device with a new developing device to decrease productivity.

SUMMARY OF THE INVENTION

The present application is directed to an image forming apparatus including a plurality of developing devices driven by a common motor in which when an initialization operation of some developing devices among the commonly driven developing devices is executed, deterioration of image quality and productivity of a developing device on which the initialization operation is not executed can be prevented.

According to an aspect of the present disclosure, an image forming apparatus includes a first developing device configured to develop an electrostatic latent image using a developer, a second developing device configured to develop an electrostatic latent image using a developer, a common driving source unit configured to commonly drive the first developing device and the second developing device, an execution unit configured, in a case where only the first developing device is exchanged for a new developing device, to execute a predetermined initialization operation to drive the first developing device and execute a toner discharge operation to discharge toner from the second developing device during the initialization operation.

According to another aspect of the present application, an image forming apparatus includes, a first developing device configured to develop an electrostatic latent image using a developer a second developing device configured to develop an electrostatic latent image using a developer, a common driving source unit configured to commonly drive the first developing device and the second developing device, an obtaining unit configured to obtain information on an developer amount consumed per unit driving time of each developing device, an execution unit configured, in a case where only the first developing device is a new developing device, to execute a predetermined initialization operation to drive the first developing device and execute a toner discharge operation to discharge toner from the second developing device, and a control unit configured, in a case where the initialization operation of only the first developing device is executed, to control based on the information on the second developing device immediately before execution of the initialization operation the toner discharge operation of the second developing device during the initialization operation.

According to yet another aspect of the present application, an image forming apparatus includes, a first developing device configured to develop an electrostatic latent image using a developer, a second developing device configured to develop an electrostatic latent image using a developer, a common driving source unit configured to commonly drive the first developing device and the second developing device, a temperature sensor configured to detect a temperature in a main body of an image forming apparatus, an execution unit configured in a case where only the first developing device is a new developing device, to execute a predetermined initialization operation to drive the first developing device and a toner discharge operation to discharge toner from the second developing device, and a control unit configured, in a case where the initialization operation of only the first developing device is executed, to control the toner discharge operation of the second developing device during the initialization operation based on a detection result of the temperature sensor when the initialization operation of only the first developing device is executed.

Further features and aspects of the present invention will become apparent from the following description of exemplary embodiments with reference to the attached drawings.

DESCRIPTION OF THE EMBODIMENTS

The following describes a first exemplary embodiment.

Image Forming Apparatus

Figure 1:
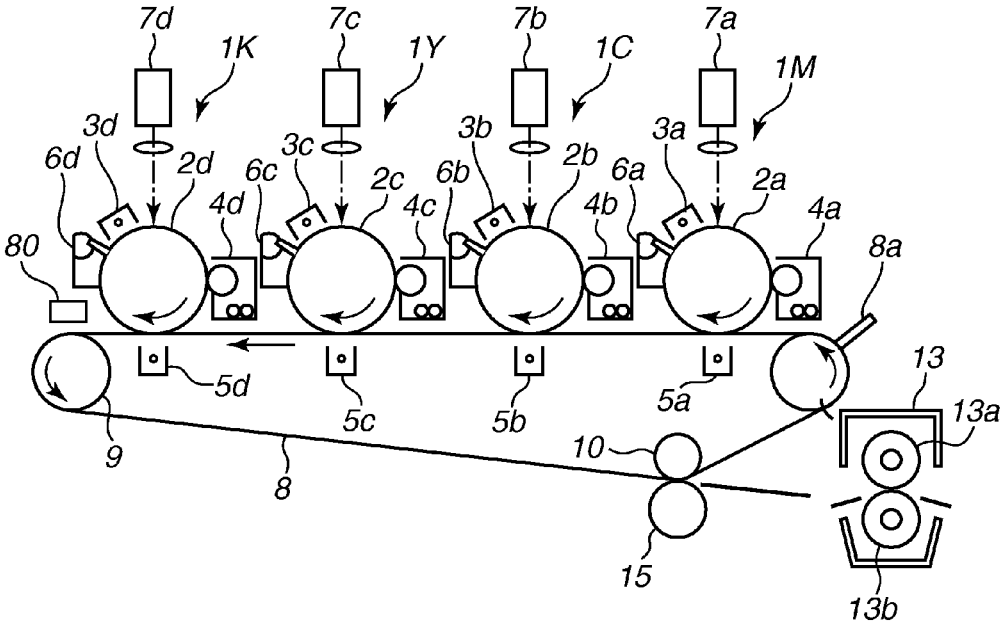
FIG. 1 is an explanatory view illustrating a configuration of an image forming apparatus according to an exemplary embodiment.

FIG. 1 is a schematic view illustrating a configuration of an image forming apparatus according to the first exemplary embodiment. The present image forming apparatus is an electrophotographic full color printer including four image forming units. The four image forming units of the image forming apparatus are provided to respectively correspond to four colors of magenta, cyan, yellow, and black. The image forming apparatus is configured such that a toner image formed on a photosensitive drum in each image forming unit is primarily transferred onto an intermediate transfer belt, which moves opposed to the photosensitive drum, and is then secondarily transferred onto a transfer medium.

Specifically, as illustrated in FIG. 1, image forming units 1M, 1C, 1Y, and 1K for magenta, cyan, yellow, and black, respectively, include photosensitive drums 2*a*, 2*b*, 2*c*, and 2*d*, respectively, as image bearing members, which rotate in the direction of arrow.

Around each of the photosensitive drums 2*a*, 2*b*, 2*c*, and 2*d* are arranged primary charging devices 3*a*, 3*b*, 3*c*, and 3*d*, developing devices 4*a*, 4*b*, 4*c*, and 4*d*, transfer charging devices 5*a*, 5*b*, 5*c*, and 5*d*, and cleaning devices 6*a*, 6*b*, 6*c*, and 6*d*, respectively. Further, laser scanners 7*a*, 7*b*, 7*c*, and 7*d*, which are exposure devices, are arranged above the photosensitive drums 2*a*, 2*b*, 2*c*, and 2*d*, respectively.

The following describes an image forming operation of the image forming apparatus. When the image forming operation is started, first, the photosensitive drums 2*a*, 2*b*, 2*c*, and 2*d* are uniformly charged by the primary charging devices 3*a*, 3*b*, 3*c*, and 3*d* and then exposed to laser beams corresponding to image signals output from the exposure devices 7*a*, 7*b*, 7*c*, and 7*d*, whereby electrostatic latent images are formed. The electrostatic latent images are visualized by toner stored in the developing devices 4*a*, 4*b*, 4*c*, and 4*d* to become visible images. The present exemplary embodiment uses a reversal developing method in which toner is attached to light portion potential exposed to laser beams.

The toner images of the respective colors are overlapped on top of another on an intermediate transfer member 8 by the primary transfer chargers 5*a*, 5*b*, 5*c*, and 5*d* and conveyed to a secondary transfer unit. At the timing when the toner images are conveyed to the secondary transfer unit, a transfer medium such as paper stored in a sheet feeding cassette is fed, and the toner images of the four colors are collectively transferred onto the transfer medium by secondary transfer rollers 10 and 15.

Then, the transfer medium is separated from the intermediate transfer belt 8, conveyed to a fixing device 13, and heated and pressed by the fixing device 13, whereby a full color permanent image is obtained. The cleaning devices 6*a*, 6*b*, 6*c*, and 6*d* collect the residual toner remaining on the photosensitive drums 2*a*, 2*b*, 2*c*, and 2*d* without being transferred by a primary transfer units. A cleaning device 8*a* collects the residual toner remaining on the intermediate transfer member 8 without being transferred by the secondary transfer unit, and the series of operation is completed.

Developing Device

Figure 2:
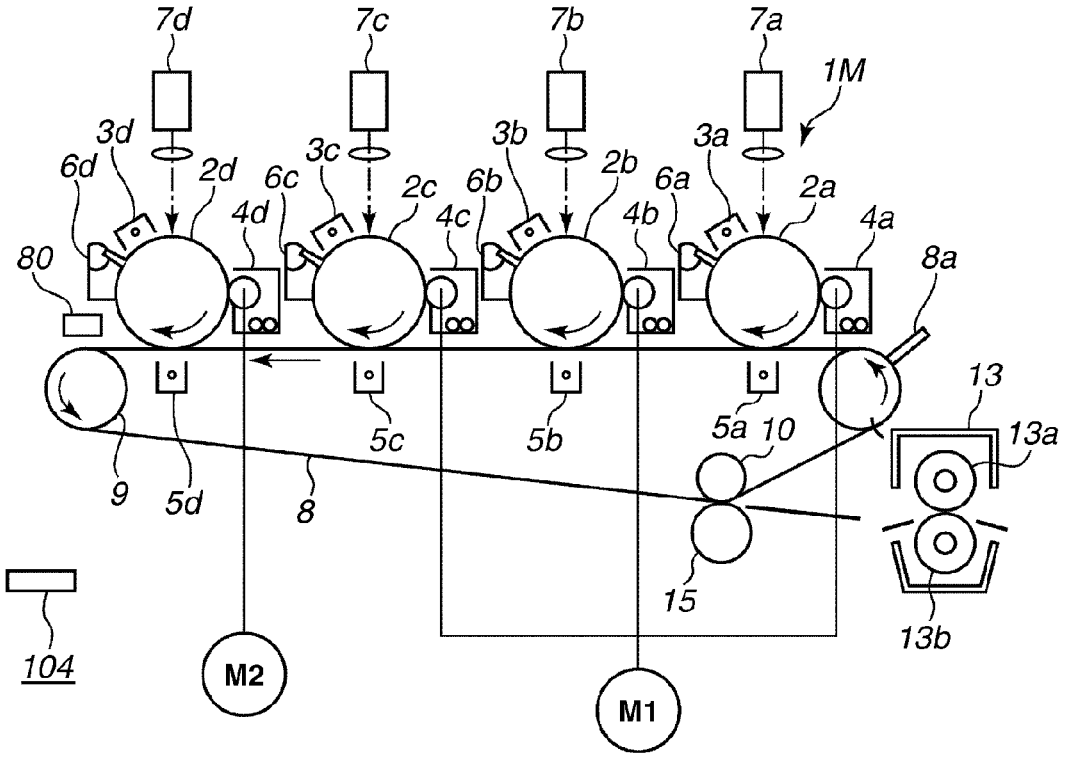
FIG. 2 is an explanatory view illustrating a driving configuration of an image forming apparatus according to an exemplary embodiment.

The following describes a driving configuration of the developing devices 4*a*, 4*b*, 4*c*, and 4*d*, with reference to FIG. 2.

In the present exemplary embodiment, the magenta, cyan, and yellow developing devices 4*a*, 4*b*, and 4*c* are commonly driven by a single common motor M1 (common driving source unit), and the black developing device 4*d* is driven by another single motor M2. This driving configuration enables the developing devices of all four colors to be driven by rotating the motors M1 and M2 during a full color mode, and enables the black developing device 4*d* to be driven alone by rotating only the motor M2 during a monochrome mode.

Figure 3:
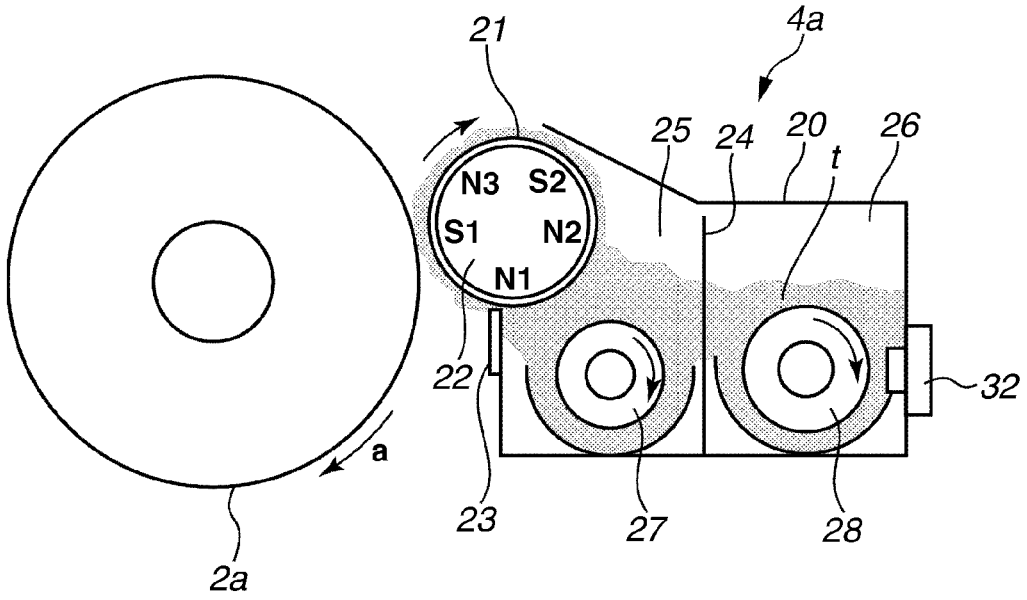
FIG. 3 is an explanatory view illustrating a configuration of a developing device according to an exemplary embodiment.

The following describes the developing devices 4*a*, 4*b*, 4*c*, and 4*d* in more detail, with reference to FIG. 3. Since the plurality of developing devices 4*a*, 4*b*, 4*c*, and 4*d* have the same configuration, only the magenta developing device 4*a* will be described.

The developing device used in the present exemplary embodiment uses a two-component developing method. As illustrated in FIG. 3, the developing device 4*a* includes a developing container 20 divided by a partition wall 24 into a developing chamber 25 and an agitating chamber 26. The developing container 20 stores therein a two-component developer t, which is a mixture of magnetic carrier particles and non-magnetic toner particles. The agitating chamber 26 installed with an inductance detection sensor 32 configured to detect the toner density of the two-component developer. Based on a detection output of the inductance detection sensor 32, a toner replenishing unit (not illustrated) arranged above the agitating chamber 26 replenishes toner into the agitating chamber 26. A specific method of toner replenishment control by the inductance detection sensor 32 will be described in detail below.

The developing container 20 has an opening formed in a portion facing the photosensitive drum 2*a*. In the opening, a rotatable development sleeve 21 including a fixed magnet 22 is arranged. Further, a regulating blade 23 is arranged near the development sleeve 21 to regulate the developer t to a predetermined layer thickness.

The developing chamber 25 includes an agitating screw 27 as a conveyance member. The agitating chamber 26 includes an agitating screw 28 as a conveyance member. The agitating screws 27 and 28 are both rotationally driven to convey the developer t in the longitudinal direction opposed to each other while stirring the developer t, whereby the developer t circulates in the developing container 20. The toner replenished from the area above the agitating chamber 26 is agitated by the rotation operation of the agitating screw 28 and charged through friction with the carrier particles in the agitating chamber 26, so that a predetermined charge amount is applied to the toner. The toner to which the charge amount is applied is passed together with the carrier particles to the agitating screw 27 and then passed onto the development sleeve 21.

The driving force from the motor M1 is first input into the development sleeve 21 and then transmitted from the development sleeve 21 to the agitating screws 27 and 28 via a gear, thereby enabling the development sleeve 21 and the agitating screws 27 and 28 to rotate concurrently.

The toner conveyed by the rotation operation of the development sleeve 21 to a portion (development nip) facing the photosensitive drum 2*a* flies onto the photosensitive drum 2*a* due to developing bias applied to the development sleeve 21. In the present exemplary embodiment, developing bias in which an AC component is superimposed on a DC component is used. The development contrast is set to 250 V, and the blank portion contrast (Vback) is set to 160 V. Further, blank pulse bias including a combination of 9-kHz rectangular pulses and blank periods is used as the AC component of the developing bias. Further, in the present exemplary embodiment, the circumferential velocity of the photosensitive drum 2*a* is set to 140 mm/sec., the rotation speed of the development sleeve 21 is set to 210 mm/sec., and the circumferential velocity ratio of the development sleeve 21 to the photosensitive drum 2*a* is set to 210/140=1.5.

Toner Replenishment Control

Figure 5:
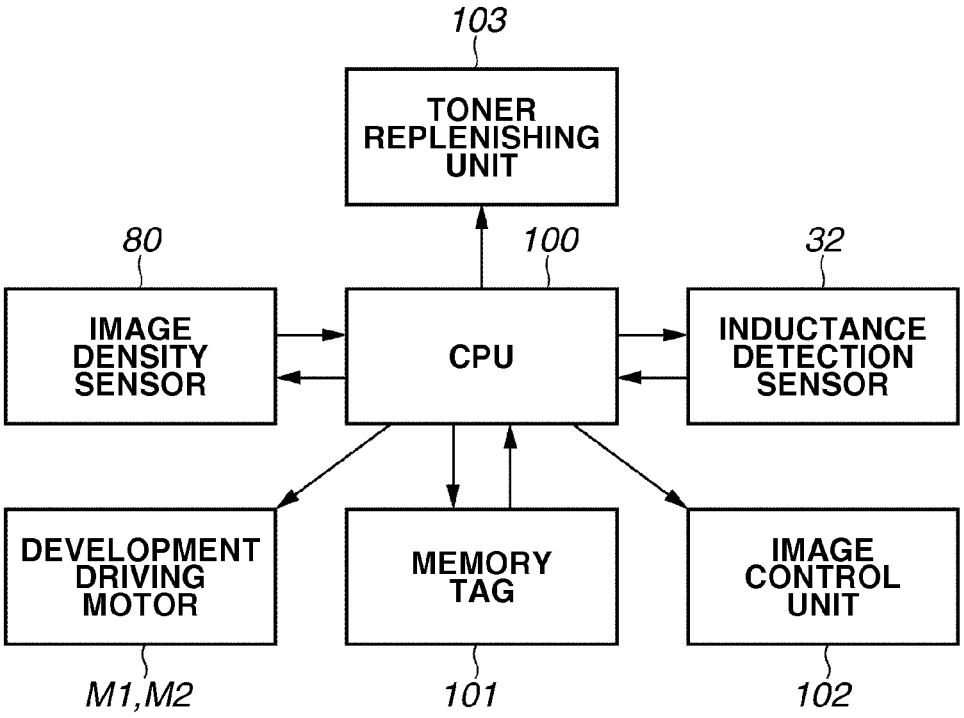
FIG. 5 is a block diagram illustrating a control according to a first exemplary embodiment.
Figure 6:
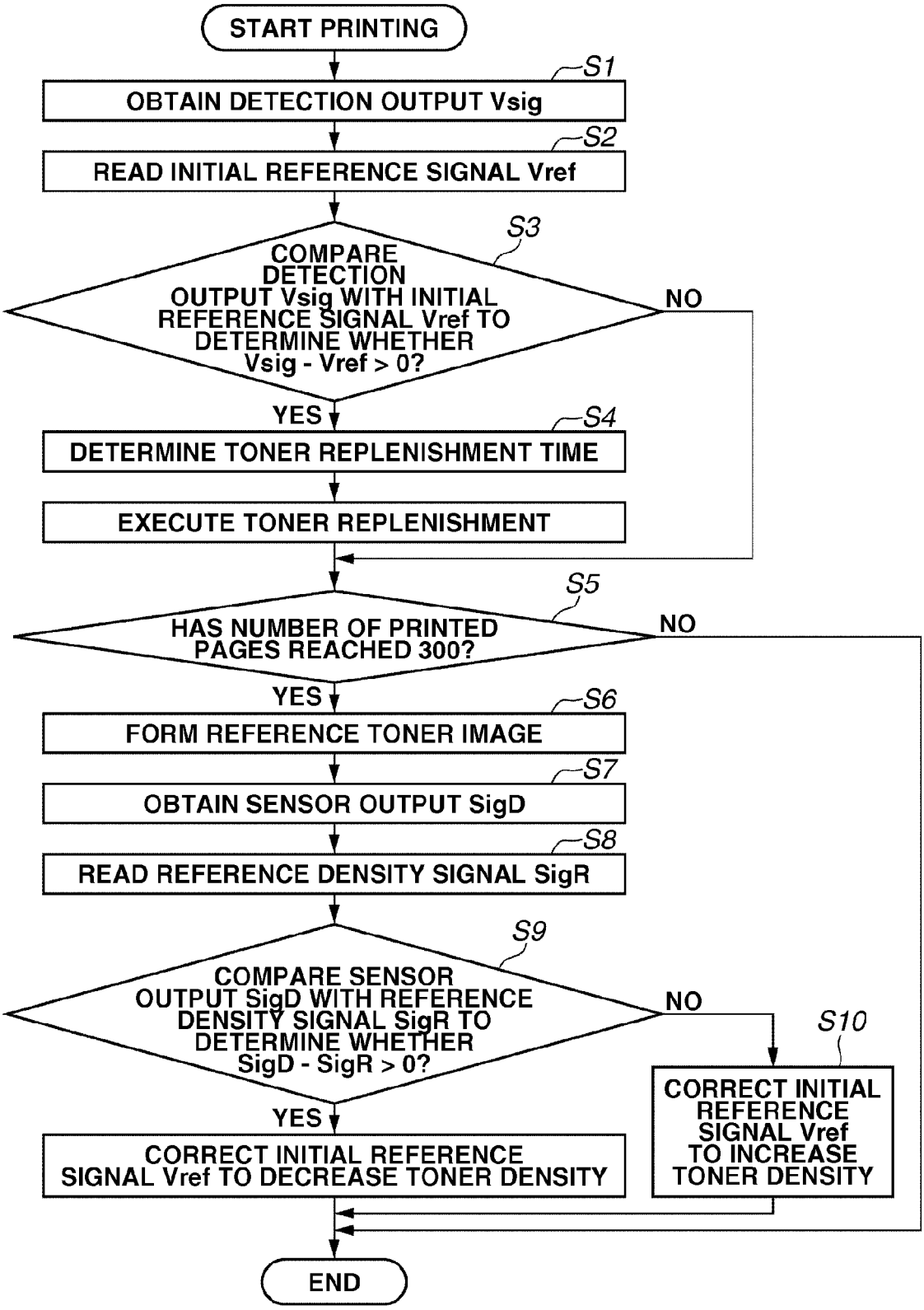
FIG. 6 is a flow chart schematically illustrating a toner replenishment control according to the first exemplary embodiment.

The following specifically describes a method of toner replenishment control by the inductance detection sensor 32 used in the present exemplary embodiment, with reference to the block diagram illustrated in FIG. 5 and the flow chart illustrated in FIG. 6.

Figure 4:
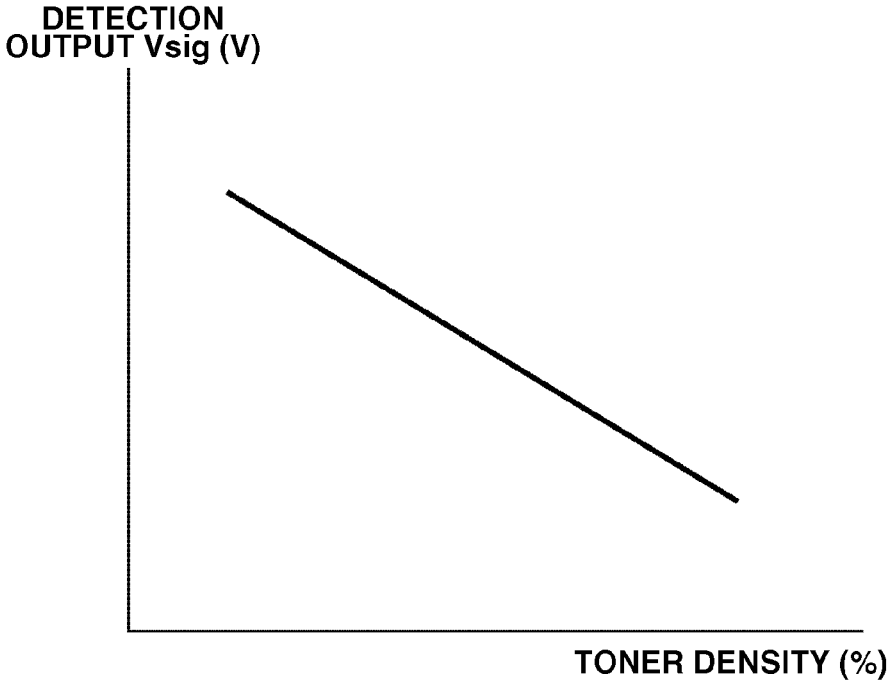
FIG. 4 is a graph illustrating the relationship between toner densities and output values of an inductance detection sensor.

Since a two-component developer contains magnetic carrier and non-magnetic toner as main components, when the toner density (the ratio of the weight of toner particles to the total weight of carrier particles and the toner particles) of the developer t changes, the apparent magnetic permeability due to the blend ratio of magnetic carrier to non-magnetic toner also changes. In step S1, a central processing unit (CPU) 100 as a control unit obtains information on the apparent magnetic permeability from the inductance detection sensor 32. As illustrated in FIG. 4, this detection output (Vsig) changes substantially linearly to the toner density (T/D ratio). In other words, the detection output of the inductance detection sensor 32 corresponds to the toner density of the two-component developer present in the developing device 4*a*.

Specifically, when the toner density increases, the ratio of non-magnetic toner in the developer increases. Thus, the apparent magnetic permeability of the developer decreases, and the detection output also decreases. In contrast, when the toner density decreases, the apparent magnetic permeability of the developer increases, and the detection output also increases. Accordingly, the toner density of the developer can be detected using the inductance detection sensor 32.

The detected detection output Vsig is recorded in advance in a memory tag 101 (not illustrated) attached to the developing device 4*a*. Then, in step S3, the CPU 100 compares the detected detection output Vsig with an initial reference signal Vref read in step S2. In step S4, based on a result of calculation of the difference between the detection output Vsig and the initial reference signal Vref (Vsig−Vref), the CPU 100 determines a period of toner replenishment to be executed by the toner replenishing unit. Since the initial reference signal Vref is an output value corresponding to an initial state of the developer, i.e., initial toner density, the detection output Vsig is controlled to be close to the initial reference signal Vref. The initial reference signal Vref is determined through an initialization operation of a developing device, which will be described below.

For example, in a case where Vsig−Vref>0 (YES in step S3), the toner density of the developer is lower than the target toner density. Thus, the CPU 100 determines a necessary amount of toner replenishment based on the difference. Accordingly, the bigger the difference between the detection output Vsig and the initial reference signal Vref is, the more the toner is replenished. Further, in a case where Vsig−Vref≤0 (NO in step S3), the toner density is higher than the target toner density. Thus, toner replenishment is stopped so that the toner density is decreased through toner consumption in an image forming operation. The toner replenishment control is executed as described above.

Correction of Inductance Reference Signal of Toner Replenishment Control

In addition to the foregoing control, correction of the initial reference signal Vref using a reference toner image is also executed in the present exemplary embodiment. The following specifically describes a method of controlling the correction.

When an image to be printed has a low image ratio, a small amount of toner is consumed. Thus, even if the toner density is constant, the time period during which the toner is charged through friction with the carrier in the developing device increases. Thus, the charge amount of the toner is likely to increase (charge-up). On the other hand, when an image to be printed has a high image ratio, the toner replacement is expedited, so that the time period during which the toner charged through friction with the carrier decreases. Thus, the charge amount of the toner is likely to decrease (charge-down). Since a change in the charge amount of the toner leads to a change in the image density, it is advantageous that the charge amount of the toner is constant.

Accordingly, in the present exemplary embodiment, the initial reference signal Vref is corrected using the reference toner image to adjust the toner density, so that the charge amount of the toner is controlled to remain constant.

The reference toner image of each color is formed in a non-image forming region at a predetermined timing such as during post-rotation and sheet-to-sheet interval. In the present exemplary embodiment, in step S5, the CPU 100 determines whether the number of printed pages has reached 300. If the number of printed pages has reached 300 (YES in step S5), then the CPU 100 controls to form latent images for the reference toner image. Specifically, in step S6, the CPU 100 controls to form latent images for the reference toner image on the photosensitive drums 2*a*, 2*b*, 2*c*, and 2*d* of the respective colors during post-rotation, and the developing devices 4*a*, 4*b*, 4*c*, and 4*d* develop the latent images to form the reference toner image. In the present exemplary embodiment, the density of the reference toner image is set to about 0.7 in terms of reflection density. The developed reference toner image is transferred onto the intermediate transfer member 8 and conveyed in the direction of the driving roller 9, which drives the intermediate transfer member 8. Near the driving roller 9, an optical image density sensor 80 is arranged to face the intermediate transfer member 8. The optical image density sensor 80 detects the density of the reference toner image of each color on the intermediate transfer member 8 one after another.

In step S7, the CPU 100 obtains a sensor output SigD from the image density sensor 80. The obtained sensor output SigD is recorded in advance in the memory tag 101 (not illustrated) attached to the developing device. In step S8, the CPU 100 reads a reference density signal SigR stored in the memory tag 101. In step S9, the CPU 100 compares the obtained sensor output SigD with the reference density signal SigR. In step S10, the CPU 100 corrects the initial reference signal Vref of the inductance detection sensor 32 based on a result of calculation of the difference between the obtained sensor output SigD and the reference density signal SigR (SigD−SigR). The corrected initial reference signal Vref_adj is stored again in the memory tag 101. The reference density signal SigR is a signal value corresponding to the initial state of the developer, i.e., initial density of the reference toner image. The signal value is determined by the initialization operation of the developing device, which will be described below.

For example, in a case where SigD−SigR>0 (YES in step S9), the density of the reference toner image is higher than the target density. In other words, the charge amount of the toner is low. Accordingly, the CPU 100 corrects the initial reference signal Vref of the inductance detection sensor 32 based on the difference to decrease the toner density. When the toner density is decreased, the charge amount of the toner increases. As a result, the charge amount that was low is corrected, so that the charge amount of the toner is maintained constant.

On the other hand, in a case where SigD−SigR≤0 (NO in step S9), the density of the reference toner image is lower than the target density. In other words, the charge amount of the toner is high. Accordingly, the CPU 100 corrects the initial reference signal Vref of the inductance detection sensor 32 based on the difference to increase the toner density. As a result, the charge amount of the toner is maintained constant. The foregoing control is executed, so that the charge amount of the toner can be maintained substantially constant.

Toner Replacement Control Associated with Initialization Operation

Figure 7:
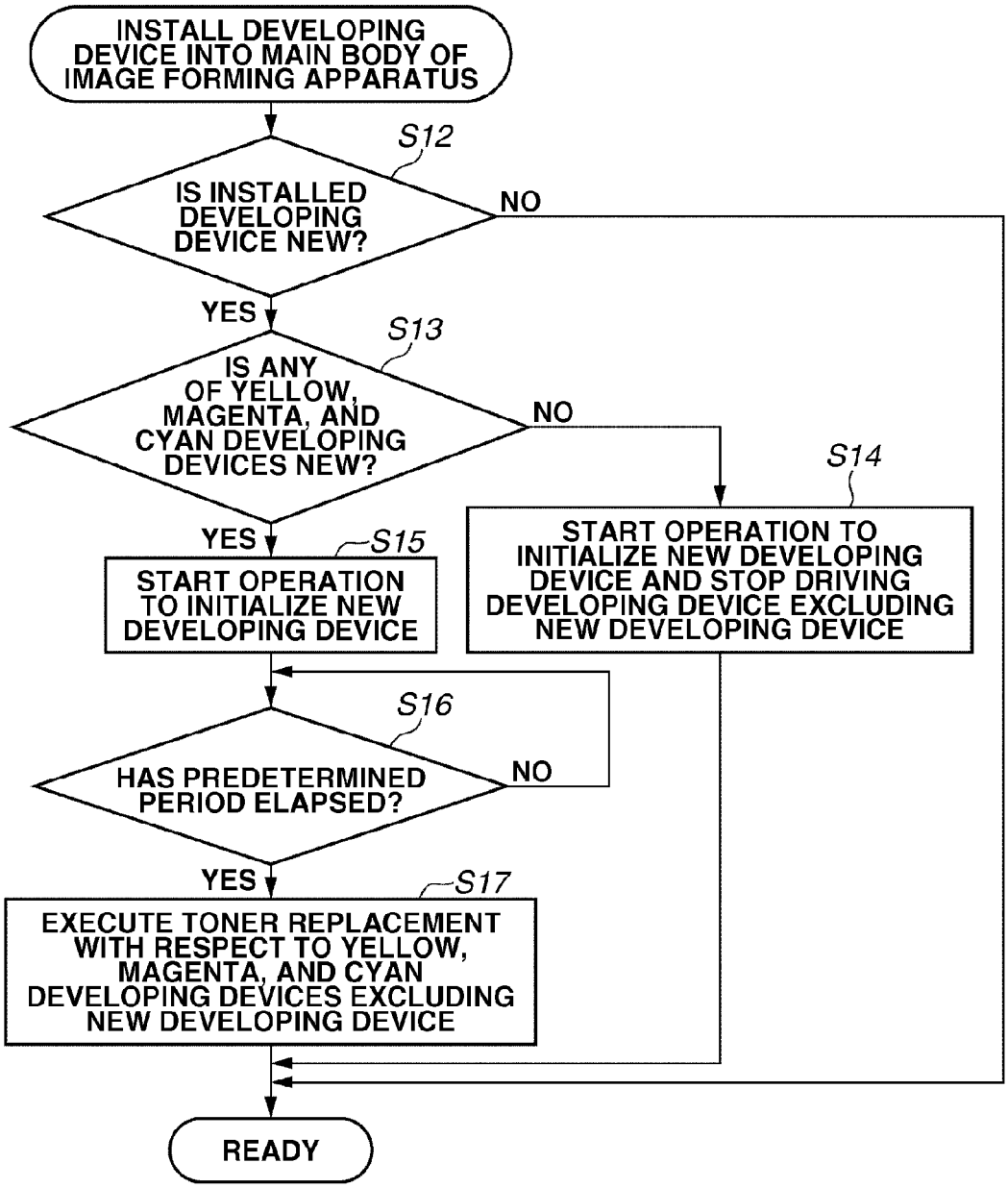
FIG. 7 is a flow chart illustrating an initialization operation control according to the first exemplary embodiment.
Figure 12:
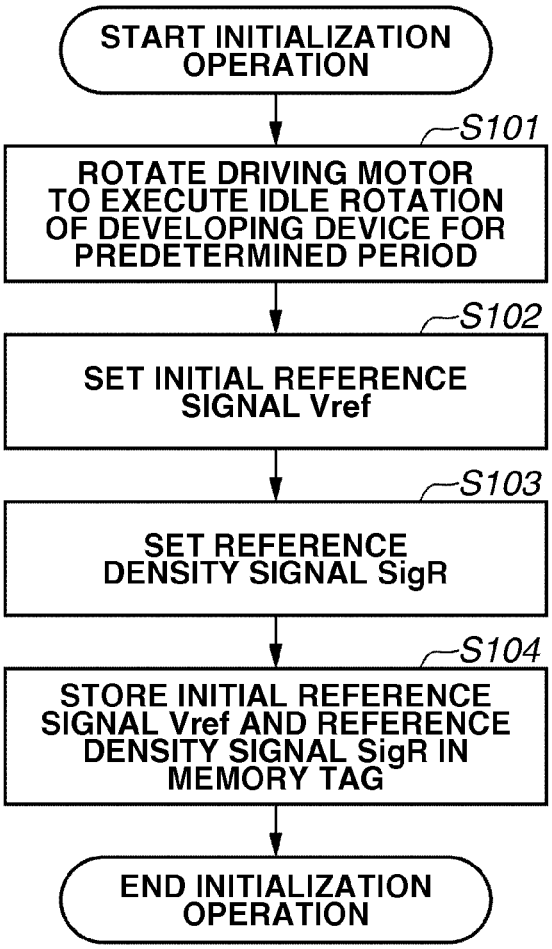
FIG. 12 is a flow chart illustrating an initialization operation control according to the present exemplary embodiment.

The following describes the initialization operation of the developing device and a toner replacement control associated with the initialization operation, which are features of the present application, with reference flow charts illustrated in FIGS. 7 and 12.

The memory tag 101 attached to the developing device stores information on whether the developing device is a new developing device. As illustrated in the flow chart of FIG. 7, when a new developing device is installed into the main body of the image forming apparatus, in step S12, the CPU 100 obtains the new product information stored in the memory tag 101 to determine whether the installed developing device is a new developing device.

A developing device that was used even once is recorded as a used developing device in the memory tag 101, so that when the used developing device is inserted into the main body of the image forming apparatus next time, the CPU 100 can determine that the inserted developing device is not new.

If the CPU 100 determines in step S12 that the installed developing device is a new developing device (YES in step S12), then in step S13, the CPU 100 determines whether any of the commonly driven developing devices is a new developing device, based on information stored in the memory tag 101. In the present exemplary embodiment, the CPU 100 determines whether any of the yellow, magenta, cyan developing devices is a new developing device. In step S14 or S15 following step S13, the initialization operation is automatically executed with respect to the developing device that the CPU 100 has determined as a new developing device. This will be described below.

On the other hand, if the CPU 100 determines in step S12 that the developing devices is not a new developing device (NO in step S12), then the image forming apparatus immediately becomes a print-ready state without execution of the initialization operation. This prevents erroneous execution of the initialization operation when a developing device that is being used is merely removed from or inserted into the image forming apparatus body. Although the present exemplary embodiment describes the case in which a new developing device is discriminated using the memory tag to automatically execute the initialization operation, other modifications are also possible. For example, a service attendant or a user may manually operate an operation unit to execute the initialization operation.

Initialization Operation

In the present exemplary embodiment, when a developing device is a new developing device, the initialization operation of the developing device is executed. The initialization operation is an operation to determine an output voltage to be a control target by storing an output of the toner density detection unit or the image density detection unit in a state in which a developer is a new developing device and, thus, the toner density is known in advance. This prevents variation of individual differences of the sensors of each of the developing devices. Furthermore, a toner density target value to be controlled can be set as appropriate. This is described in detail below, with reference to the flow chart illustrated in FIG. 7.

If the CPU 100 determines in step S13 that all of the yellow, magenta, and cyan developing devices are new or none of the yellow, magenta, and cyan developing devices is a new developing device (NO in step S13), then in step S14, the CPU 100 starts the initialization operation of the new developing devices and stops driving the developing devices other than the new developing devices. On the other hand, if the CPU 100 determines in step S13 that one or more but not all of the yellow, magenta, and cyan developing devices are new (YES in step S13), then in step S15, the CPU 100 starts the initialization operation of the new developing device(s). In step S16, the CPU 100 determines whether a predetermined period has elapsed. If the CPU 100 determines that the predetermined time has elapsed (YES in step S16), then in step S17, the CPU 100 controls to sequentially execute the toner replacement control with respect to the yellow, magenta, and cyan developing devices excluding the new developing device(s). The toner replacement control will be described below. In the present exemplary embodiment, the timing to start the toner replacement is set such that the toner replacement control is completed during the initialization operation to reduce downtime. As used herein, the phrase "the toner replacement control is completed" refers to a state in which at least an operation to form a latent image for toner replacement on a drum is completed.

The following specifically describes the initialization operation, with reference to the flow chart illustrated in FIG. 12.

The initialization operation is configured to be executable by the CPU 100 as an execution unit. In step S101, when execution of the initialization operation is started, first, the CPU 100 controls to rotate the driving motor such that idle rotation of the developing device is executed for two minutes and thirty seconds. This control is executed to smooth the height of the developer surface and to increase the charge amount of the toner.

Following the idle rotation, in step S102, the CPU 100 sets the initial reference signal Vref of the inductance detection sensor 32. Specific setting of the initial reference signal Vref is executed as follows. First, while the CPU 100 gradually changes the control voltage of the inductance detection sensor 32, outputs are detected. Then, the control voltage is set such that an output is about 2.5 V, and an output value at the set control voltage is set as the initial reference signal Vref. The set initial reference signal Vref is sent to the memory tag 101 and stored therein.

Then, in step S103, the reference density signal SigR of the image density sensor is set. The reference density signal SigR is set by detecting the density of the formed reference toner image using the density sensor to set the detected density as the reference density signal SigR. In step S104, the set reference density signal SigR is sent to the memory tag 101 and stored therein.

At this time, the series of initialization operation is completed, and the image forming apparatus is in a print-ready state. It is to be noted that while the setting of the initial reference signal Vref and the reference density signal SigR is executed, the developing device is driven continuously.

Although the driving time of the developing device in the initialization operation of the present exemplary embodiment is two minutes and fifty seconds in total, the driving time may be selected as appropriate to each developing device.

The following describes a specific example of the initialization operation, with reference to FIG. 7. The memory tag 101 attached to the developing device stores color information as well as the new product information. When a developing device is installed into the image forming apparatus body in step S12, the color information is sent to the CPU 100, and in step S13, the CPU determines the color of the installed developing device. In step S14, if the installed new developing device is a black developing device, only the motor M2 is rotated during the initialization operation, so that only the black developing device is driven. Thus, the developing devices of the other three colors are stopped during the initialization operation of the black developing device. This prevents unnecessary idle rotation of developing devices other than the developing device that is in the initialization operation.

On the other hand, in step S15, if the installed new developing device is, for example, a magenta developing device, only the motor M1 is rotated to drive the magenta developing device during the initialization operation. At this time, since the motor M1 is a common driving motor for the cyan and yellow developing devices, the cyan and yellow developing devices are also commonly driven during the initialization operation of the magenta developing device.

When the initialization operation of the magenta developing device is started, the motor M1 starts rotating at a predetermined timing to start driving the respective developing devices of magenta, cyan, and yellow. As described above, the total driving time of a developing device in the initialization operation of the developing device is two minutes and fifty seconds in the present exemplary embodiment, each of the cyan and yellow developing devices is also driven for the same period of time. This leads to toner deterioration as described above. Hence, the following toner replacement control is executed in step S17 in the present exemplary embodiment.

Toner Replacement Control

The CPU 100 as a control unit controls the toner replacement control.

Specifically, in step S16, the CPU 100 determines whether a period of two minutes and thirty seconds has passed since the rotation of the motor M1 was started. The CPU 100 performs control such that when a period of two minutes and thirty seconds has passed since the rotation of the motor M1 was started, latent images of A3-size completely solid image are formed on the photosensitive drums 2*b* and 2*c*. The amount of toner to be discharged at this time is sufficient to compensate at least the developer amount deteriorated due to the initialization operation. It is apparent that the amount of toner to be discharged is not limited to an A3-size completely solid image and maybe set as appropriate according to the time period of the initialization operation.

The latent images are developed by the cyan and yellow developing devices, so that a predetermined amount of toner is discharged from each developing device. Then, in step S17, the CPU 100 controls the cyan and yellow toner replenishing units such that each of the cyan and yellow toner replenishing units replenishes substantially the same amount (about 0.72 g) of toner as the amount of discharged toner. Consequently, the toner in the developing device is replaced by fresh toner. It is to be noted that the toner is considered to have deteriorated more in the last half of the total rotation period of two minutes and fifty seconds. Thus, the toner replacement is started after the period of two minutes and thirty seconds has passed since the motor M1 started rotating, so that the effect of the toner replacement becomes higher.

The toner images developed on the photosensitive drums 2*b* and 2*c* are transferred onto the intermediate transfer member 8 not to overlap each other and then collected by the cleaning device 8*a*. The reason why the toner images are transferred onto the intermediate transfer member 8 not to overlap each other is to prevent a large amount of toner from entering the cleaning device 8*a* at one time.

Although the present exemplary embodiment describes the case in which the installed new developing device is the magenta developing device, the toner replacement of the developing devices other than the developing device that is in the initialization operation is executed also when a new cyan or yellow developing device is installed. When the control is executed, the motor M2 is stopped, so that the black developing device is not driven. Thus, it is not necessary to execute the toner replacement control for the black developing device.

Further, since the magenta developing device is also driven for the period of two minutes and fifty seconds due to the initialization operation, toner deterioration also occurs in the magenta developing device. However, since the magenta developing device originally started with a new agent, the degree of deterioration is low. Furthermore, the initialization operation is executed with the state after the idle rotation of two minutes and fifty seconds being defined as an initial state. Thus, omission of toner replacement for magenta will not cause a problem.

Figure 8:
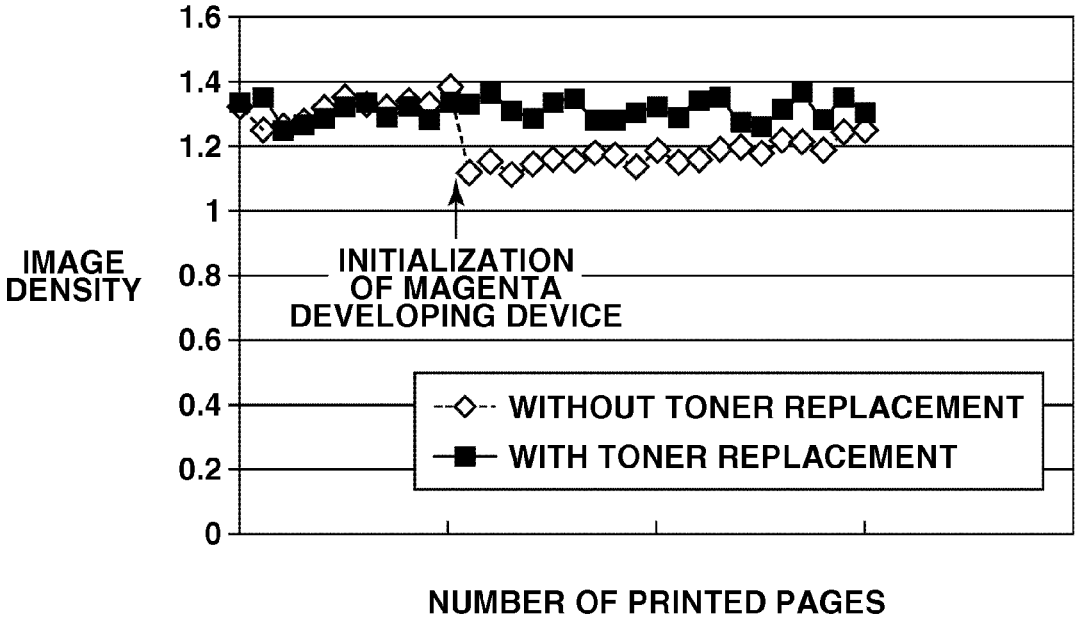
FIG. 8 is a graph illustrating the transition of the image density of a developing device other than a developing device that is subjected to an initialization operation in the case of executing the control according to the first exemplary embodiment and in the case of not executing the control according to the first exemplary embodiment.

FIG. 8 illustrates the transition of the image density when the initialization operation of the magenta developing device is executed in the case where the cyan developing device continues to be idly rotated and in the case where toner replacement of the cyan developing device is executed as in the present exemplary embodiment. From FIG. 8 it is understood that the cyan density changes considerably before and after the initialization operation of the magenta developing device in the case where the developing device continues to be idly rotated without toner replacement, whereas the density is successfully maintained in the case where the toner replacement control is executed. It is considered that when the toner replacement control is not executed, deteriorated toner remains in the developing device to decrease developing performance and transfer property, thereby decreasing image density.

Meanwhile, when only images with a low image ratio are continuously printed, the state of the developing device becomes similar to the state where the developing device is idly rotated, and developing performance and transfer property decrease due to toner deterioration. Thus, the following conventional toner replacement control is executed in the present exemplary embodiment. In other words, when only images with a low image ratio are printed, the CPU 100 executes the control to replace a predetermined toner based on the average image ratio. Specifically, the average image ratio, which is the developer amount consumed per unit driving time of the development sleeve, is calculated from an integrated value of a video count number corresponding to an image information signal and an integrated value of a rotation period of the development sleeve 21. When the average image ratio becomes short compared to the target image ratio, the CPU 100 executes the control to replace the toner as much as a shortfall of the image ratio.

The toner replacement control based on the image ratio as described above may be executed with respect to the cyan and yellow developing devices when the initialization operation of the magenta developing device is executed. In this case, however, the following problem arises.

When the initialization operation of the magenta developing device is executed, the cyan and yellow developing devices are in an idle rotation state. Thus, during that time, the video count number is not integrated, and only the rotation period of the development sleeve 21 is integrated. Consequently, the average image ratio reaches the threshold value for execution of toner replacement in the middle of the idle rotation operation. However, the timing at which the average image ratio reaches the threshold value differs depending on the operating conditions before the initialization operation. Thus, in some cases, toner replacement is executed immediately before the initialization operation of the magenta developing device is completed. Hence, even when the initialization operation is completed, extra downtime as much as the toner replacement operation is generated. Especially when the toner replacement control is executed with respect to a plurality of developing devices, the downtime becomes even longer.

In other words, if the conventional feedback control based on the average image ratio is applied without any modification, downtime is generated due to the toner replacement control to decrease productivity.

On the other hand, if the feedforward control based on an idle rotation period known in advance is applied as in the present disclosure to execute the toner replacement control concurrently with the initialization operation, the toner replacement can be executed without generating any unnecessary downtime.

Although the present exemplary embodiment describes the developing devices configured to execute development using a two-component developer, the control according to the present exemplary embodiment is also applicable to a developing device configured to execute development using a mono-component developer.

Further, although the present exemplary embodiment describes the case in which the yellow, magenta, and cyan developing devices are commonly driven, the number of developing devices to be commonly driven may be any plural number and may be a number other than 3. For example, the yellow developing device (first developing device) and the magenta developing device (second developing device) may commonly be driven.

The foregoing control is executed, so that the toner replacement is executed concurrently with the initialization operation without generating unnecessary downtime, whereby a decrease in density and defective images due to toner deterioration can be prevented. Furthermore, an image forming apparatus that is capable of stably producing high quality images can be provided.

The following describes a second exemplary embodiment.

Developing devices and an image forming apparatus according to the present exemplary embodiment have similar configurations as those in the first exemplary embodiment. The present exemplary embodiment is characterized in that whether the toner replacement control can be executed is determined, or the amount of toner to be replaced during the toner replacement control is corrected, based on the average image ratio immediately before the start of the initialization operation. The present exemplary embodiment is also characterized in that whether the toner replacement can be executed is determined, or the amount of toner to be replaced during the toner replacement control is corrected, based on the temperature in the main body of the image forming apparatus immediately before the execution of the initialization operation.

In the first exemplary embodiment, for example, when the initialization operation of the magenta developing device is executed, a predetermined amount of toner of each of the cyan and yellow developing devices is consumed and replaced concurrently. However, the amount of toner to be replaced may be excessive or insufficient depending on the state of the developer. For example, if images with a high image ratio of cyan toner were continuously printed immediately before the execution of the initialization operation of the magenta developing device, a large amount of toner has been replaced in the cyan developing device. Thus, the degree of toner deterioration is low. In such a case, if the control is executed such that a constant amount of toner is always replaced, an excessive amount of toner is replaced in view of the degree of toner deterioration. This leads to consumption of excess toner. On the other hand, if images with an extremely low image ratio of cyan toner were continuously printed, the degree of toner deterioration is high. Thus, the amount of toner replacement in the toner replacement control is sometimes insufficient.

Figure 11:
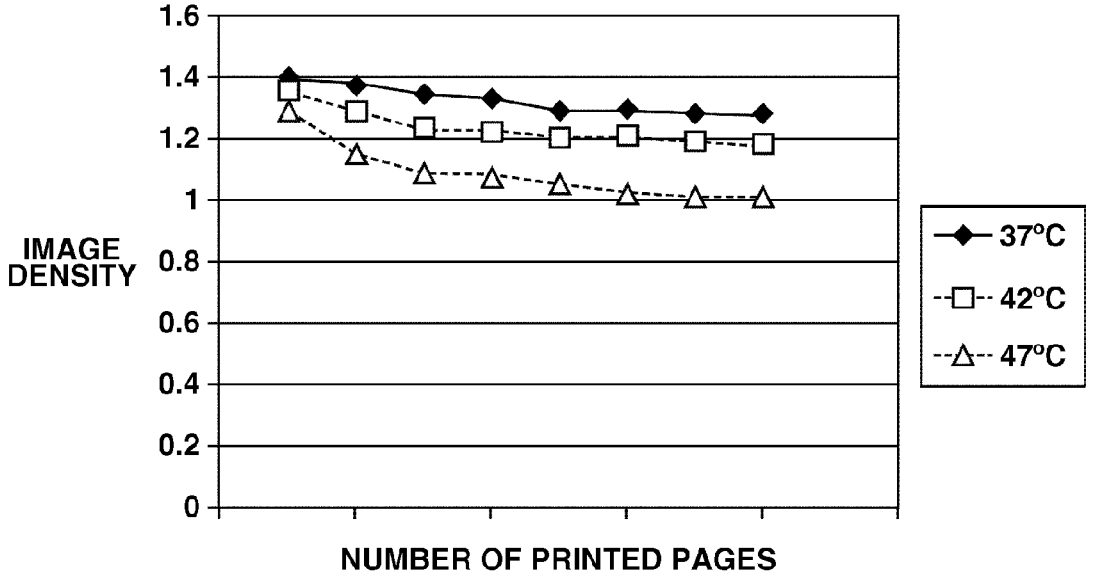
FIG. 11 is a graph illustrating the transition of the image density for each temperature in the image forming apparatus in the case of continuously printing images with an image ratio of 1%.

Further, the studies conducted by the present inventors show that even when the average image ratios are the same, the degree of toner deterioration in the developing device differs depending on the temperature in the image forming apparatus to affect developing performance and transfer property. FIG. 11 illustrates how the image density changes due to the temperature in the image forming apparatus when images with a low image ratio of 1% are continuously printed at a constant development contrast. From FIG. 11 it is understood that the image density decreases more significantly at higher temperatures in the image forming apparatus. This is considered to be due to the following factor. When the temperature in the image forming apparatus is high, the temperature of the toner in the developing device is also high. When the temperature of the toner is high, if mechanical pressure is applied by rotation of the development sleeve, an external additive is easily embedded to expedite toner deterioration.

Figure 9:
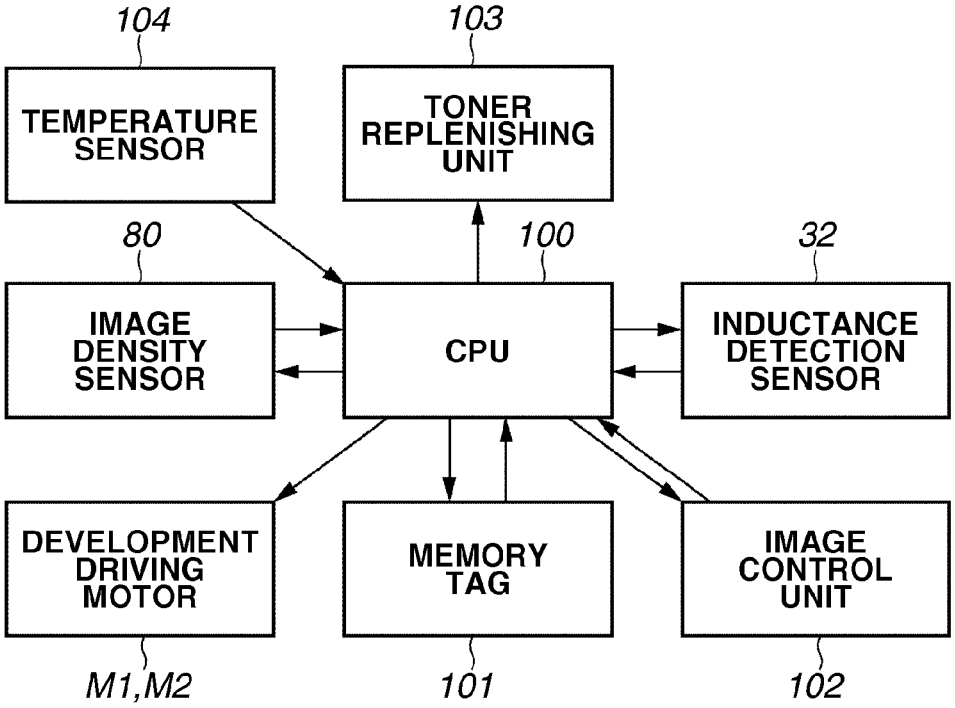
FIG. 9 is a block diagram illustrating a control according to a second exemplary embodiment.
Figure 10:
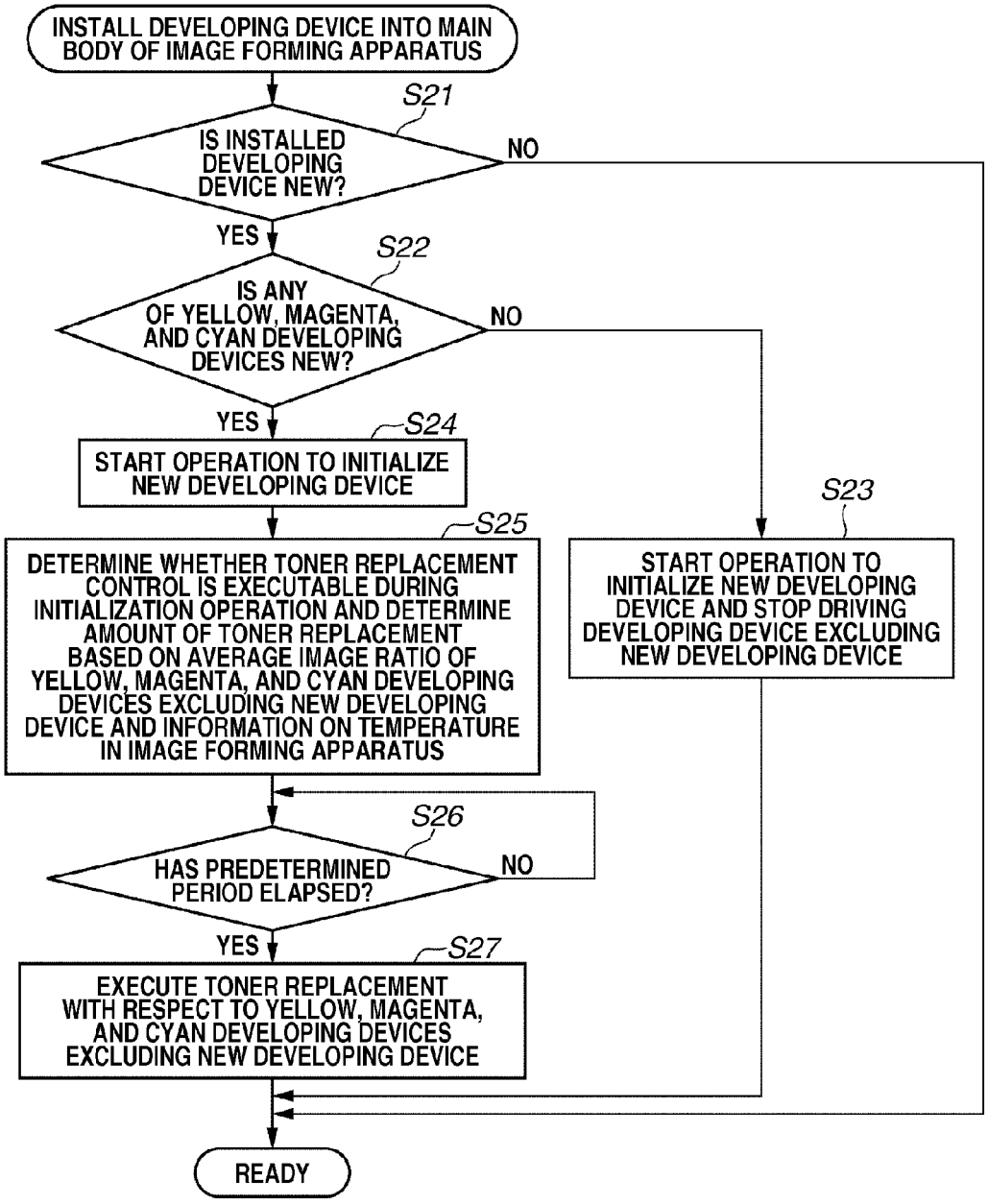
FIG. 10 is a flow chart illustrating an initialization operation control according to the second exemplary embodiment.

Therefore, the degree of toner deterioration in the cyan and yellow developing devices, which come into an idle rotation state at the same time, changes depending on the temperature in the image forming apparatus during the execution of the initialization operation of the magenta developing device. Therefore, if the control is executed such that a constant amount of toner is always replaced, the amount of replaced toner is sometimes excessive. Accordingly, in the present exemplary embodiment, the toner replacement control is executed concurrently with the initialization operation of the developing device such that the amount of toner replacement is changed according to the average image ratio of images printed by that time and the temperature in the image forming apparatus at that time. The following describes the control of the present exemplary embodiment in detail, with reference to FIGS. 9 and 10.

During a normal image forming period, the image control unit 102 counts the video count number in response to image signals of printed images, and the CPU 100 integrates the counted number. Then, the integrated value is stored in the memory tag 101. The driving times of the driving motor M1 and M2 are also integrated by the CPU 100 and stored in the memory tag 101. The memory tag 101, the image control unit 102, and the CPU 100 function as an obtaining unit configured to obtain information on the developer amount consumed per unit driving time of the development sleeve. The present exemplary embodiment describes as an example a case where the magenta developing device is exchanged for a new developing device. In step S21, if the CPU 100 determines that the exchanged magenta developing device is a new developing device based on the new product information stored in the memory tag 101 (YES in step S21), then the initialization operation of the magenta developing device is automatically started as in the first exemplary embodiment. Simultaneously, in step S25, the CPU 100 reads the integrated value of the vide count and the driving time of the driving motor M1 from the memory tag 101 of each of the cyan and yellow developing devices to calculate an average image ratio by that time. Furthermore, in step S25, the CPU 100 reads the temperature immediately before the execution of the initialization operation from the temperature sensor 104 attached to the main body of the image forming apparatus. Furthermore, in step S25, the CPU 101 determines whether the toner replacement control can be executed during the initialization operation and also determines the amount of toner to be replaced based on the average image ratio and the temperature in the image forming apparatus according to Table 1 below.

TABLE 1

| Average image ratio | Temperature in image forming apparatus: Lower than 35° C. | 35° C. or higher and lower than 42° C. | 42° C. or higher |
|---|---|---|---|
| Lower than 2% | 0.71 g | 0.79 g | 0.94 g |
| 2% or higher and lower than 5% | 0.68 g | 0.72 g | 0.86 g |
| 5% or higher and lower than 30% | 0.61 g | 0.65 g | 0.77 g |
| 30% or higher and lower than 60% | 0.34 g | 0.36 g | 0.43 g |
| 60% or higher | 0 g | 0 g | 0.18 g |

Specifically, the lower the average image ratio is, and the higher the temperature in the image forming apparatus is, which is a detection result of the temperature sensor 104, the higher the degree of toner deterioration is determined, and the amount of toner replacement is increased to prevent defective images due to toner deterioration. On the other hand, in a case where the average image ratio is high and the temperature in the image forming apparatus is low, the CPU 100 determines that the degree of toner deterioration is low and decreases the amount of toner replacement to prevent unnecessary toner consumption. The following describes a case where the average image ratio of the cyan developing device is 1%, the average image ratio of the yellow developing device is 65%, and the temperature in the image forming apparatus is 40° C. In this case, the cyan developing device forms an image that is 1.1-fold the length of an A3 solid image in the sub-scanning direction to discharge toner and is replenished with substantially the same amount (0.79 g) of toner as the discharged toner. As to the yellow developing device, Table 1 shows that the amount of toner replacement is 0 g. Thus, no toner replacement is executed for the yellow developing device. Accordingly, a most appropriate amount of toner replacement is determined for each color according to Table 1. Execution of such a control enables toner replacement with an appropriate amount of toner according to the degree of toner deterioration. At this time, the discharge starting timing is set in advance from the toner discharge amount of each of the yellow and cyan developing devices under the conditions specified in Table 1 such that the toner replacement control with respect to the yellow and cyan developing devices is completed during the initialization operation of the magenta developing device.

In the present exemplary embodiment, the toner replacement starting timing is set such that the toner replacement control is completed before the initialization operation is completed. However, the present disclosure is not limited to this exemplary embodiment. For example, even when the toner replacement control is completed after the initialization operation is completed, the toner discharge starting timing may be set earlier than the case of executing the feedback type toner replacement control to decrease downtime. Specifically, the CPU 100 obtains the average printing ratio immediately before the initialization operation to determine whether the average image ratio is likely to exceed the threshold value for execution of the toner replacement operation during the initialization operation. If the CPU 100 determines that the average image ratio is likely to exceed the threshold value for execution of the toner replacement operation during the initialization operation, the toner replacement operation may be started a predetermined time earlier from the timing at which the average image ratio is likely to exceed the threshold value during the initialization operation. To minimize downtime, it is useful that the toner replacement control starting timing is set such that the toner replacement control is completed before the initialization operation is completed.

As the foregoing describes, in the image forming apparatus in which the plurality of developing devices are driven by a common motor, when the initialization operation of only a specific developing device is executed, an appropriate amount of toner is replaced according to the degree of toner deterioration in the developing device other than the developing device in the initialization operation. In the present exemplary embodiment, the toner replacement control is executed concurrently with the initialization operation to provide an image forming apparatus capable of stably and constantly producing high quality images while avoiding unnecessary toner consumption.

Although the present exemplary embodiment describes the case where the amount of toner replacement in the toner replacement operation executed concurrently with the initialization operation is determined based on the information on the average image ratio and the temperature information, the amount of toner replacement may be determined only based on at least one of the information on the average image ratio and the temperature information.

The present disclosure provides an image forming apparatus capable of preventing a decrease in image quality and productivity of a developing device on which no initialization operation is performed when the initialization operation of a developing device among a plurality of commonly driven developing devices driven by a common motor is executed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-127134 filed Jun. 4, 2012, which is hereby incorporated by reference herein in its entirety.

What is claimed is:

1. An image forming apparatus comprising:

a first developing device configured to develop an electrostatic latent image formed on a first image bearing member;

a second developing device configured to develop an electrostatic latent image formed on a second image bearing member;

a common driving source unit configured to commonly drive the first developing device and the second developing device; and a control unit configured to control a predetermined initialization operation with respect to each exchanged developing device by driving the first developing device and the second developing device in a case where at least one of the first developing device and the second developing device is exchanged for a new developing device;

wherein, in a case where either one of the first developing device or the second developing device is exchanged for a new developing device and the other developing device is not exchanged for a new developing device, the control unit executes the initialization operation with respect to said one of the developing devices and doesn't execute the initialization operation with respect to the other developing device, and wherein the control unit executes a replacement operation, that is different from the initialization operation, for replacing a developer disposed in a developing device with respect to the other developing device while executing the initialization operation of said one of the developing devices, and doesn't execute the replacement operation to said one of the developing devices.

2. The image forming apparatus according to claim 1, wherein the control unit performs control such that the replacement operation is completed during the predetermined initialization operation.

3. The image forming apparatus according to claim 1, further comprising a temperature sensor configured to detect a temperature in a main body of the image forming apparatus, wherein the control unit controls based on a detection result of the temperature sensor the replacement operation.

4. The image forming apparatus according to claim 3, wherein the control unit performs control such that an amount of the toner discharged during the replacement operation increases as the detection result of the temperature sensor is higher.

5. The image forming apparatus according to claim 1, wherein based on a developer amount consumed per unit driving time of the other developing device, a mode in which the toner in the other developing device is forcibly consumed during a non-image forming period is executable, and the replacement operation is executable at a timing before the toner discharge operation in the mode is started, during the predetermined initialization operation.

6. The image forming apparatus according to claim 1, wherein the initialization operation includes an operation for forming a predetermined patch image with the exchanged developing device and setting a controlling parameter regarding the exchanged developing device based on the patch image.

7. The image forming apparatus according to claim 1, further comprising:

a third developing device configured to develop an electrostatic latent image formed on a third image bearing member; and a second driving source unit configured to drive the third developing device;

wherein in a case where the first developing device is exchanged for a new developing device and the second developing device and the third developing device are not exchanged for a new developing device, the control unit executes the initialization operation with respect to the first developing device, and doesn't execute the initialization operation with respect to the second developing device and the third developing device, and executes the replacement operation with respect to the second developing device and doesn't execute the replacement operation with respect to the third developing device.

8. An image forming apparatus comprising:

a first developing device configured to develop an electrostatic latent image formed on a first image bearing member;

a second developing device configured to develop an electrostatic latent image formed on a second image bearing member;

a common driving source unit configured to commonly drive the first developing device and the second developing device; and a control unit configured to perform a control so that a predetermined initialization operation is executed with respect to each exchanged developing device by driving the first developing device and the second developing device, in a case where at least one of the first developing device and the second developing device is exchanged for a new developing device;

an obtaining unit configured to obtain information on a developer amount consumed per unit driving time of each developing device;

wherein, in a case where either one of the first developing device or the second developing device is exchanged for a new developing device and the other developing device is not exchanged for a new developing device, the control unit executes the initialization operation with respect to said one of the developing devices and doesn't execute the initialization operation with respect to the other developing device, and wherein, before said one of the developing devices executes the initialization operation and based on information obtained by the obtaining unit, the control unit determines whether to execute a replacement operation or not, that is different from the initialization operation, for replacing a developer disposed in a developing device with respect to the other developing device while executing the initialization operation of said one of the developing devices.

* * * * *